US005797572A

United States Patent [19]

Schmucki et al.

[11] Patent Number: 5,797,572

[45] Date of Patent: Aug. 25, 1998

[54] PLUMBING FIXTURE MOUNTING DEVICE USING A THREADED ROD WITH INTERRUPTED THREADS

[75] Inventors: Peter Schmucki, Eschenbach; Silvio Marti, Jona, both of Switzerland

[73] Assignee: Geberit Technik AG, Jona, Switzerland

[21] Appl. No.: 643,859

[22] Filed: May 7, 1996

[30] Foreign Application Priority Data

May 23, 1995 [CH] Switzerland ..... 1515/95-3

[51] Int. Cl.[6] ..... A47B 96/06

[52] U.S. Cl. ..... 248/222.52; 248/224.8; 248/231.91; 52/698; 52/713; 411/418; 411/553

[58] Field of Search ..... 403/320; 411/411, 411/417, 418, 553; 52/698, 713, 34, 35; 248/222.52, 224.8, 231.91

[56] References Cited

U.S. PATENT DOCUMENTS

| | | | |
|---|---|---|---|
| 1,372,238 | 3/1921 | Kreiter | 403/320 X |
| 1,390,904 | 9/1921 | Hazelton | 411/417 X |
| 1,451,970 | 4/1923 | Taylor | 411/418 |
| 3,720,430 | 3/1973 | St. Paul . | |

FOREIGN PATENT DOCUMENTS

| | | | |
|---|---|---|---|
| 641767 | 5/1962 | Canada | 411/417 |
| 2289794 | 10/1974 | France | 411/417 |
| 733 952 | 3/1943 | Germany . | |
| 295 01 299.1 | 4/1995 | Germany . | |
| 0 151 263 | 8/1995 | Germany . | |
| 488075 | 5/1970 | Switzerland | 52/713 |

OTHER PUBLICATIONS

McMaster–Carr Supply Co. Catalog #99, p. 2328, 1993.

*Primary Examiner*—Leslie A. Braun
*Assistant Examiner*—Donald J. Wallace
*Attorney, Agent, or Firm*—McGlew & Tuttle

[57] ABSTRACT

The device has a mounting frame with a nut housing, into which a threaded rod is inserted. The threaded rod has interrupted teeth and meshes with a nut, which likewise has interrupted teeth. An adjustable carrier, with which the threaded rod can be detachably fixed at each depth of insertion, is arranged behind the nut. A time-consuming screwing in and out of the threaded rod as well as fixing with a lock nut are avoided.

11 Claims, 2 Drawing Sheets

Fig. 1
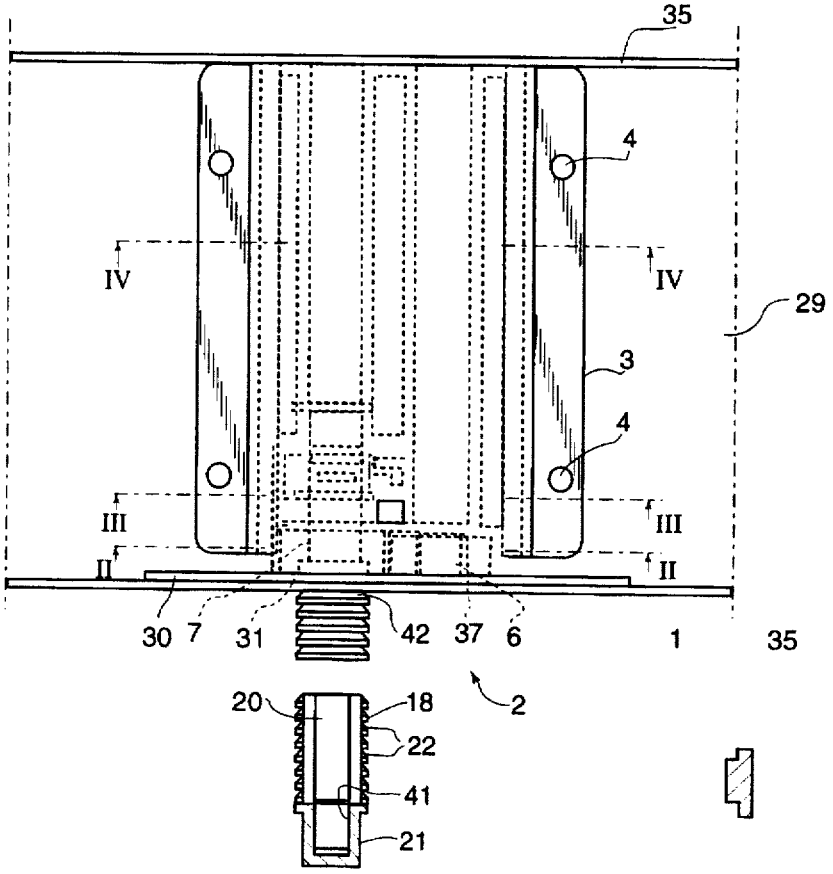
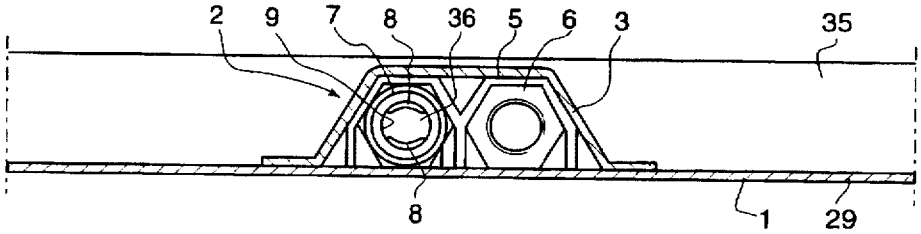
Fig. 2
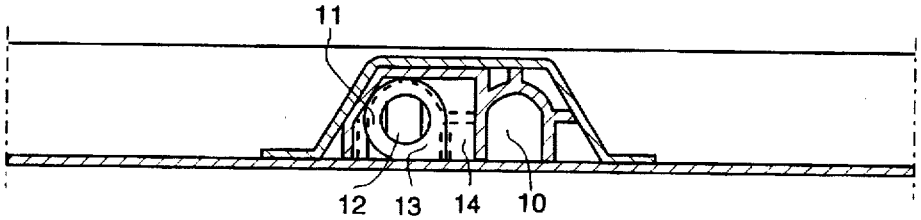
Fig. 3
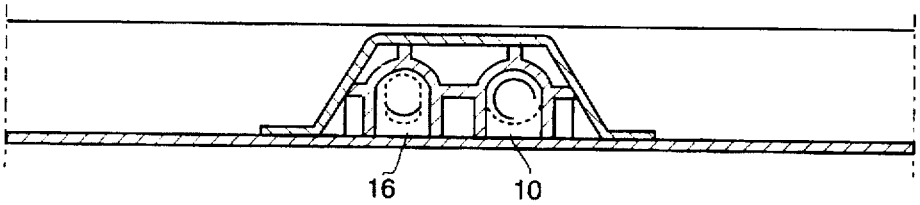
Fig. 4

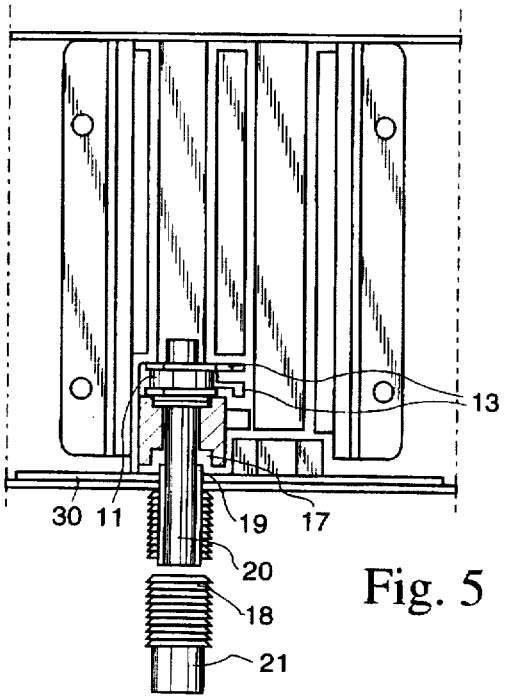
Fig. 5
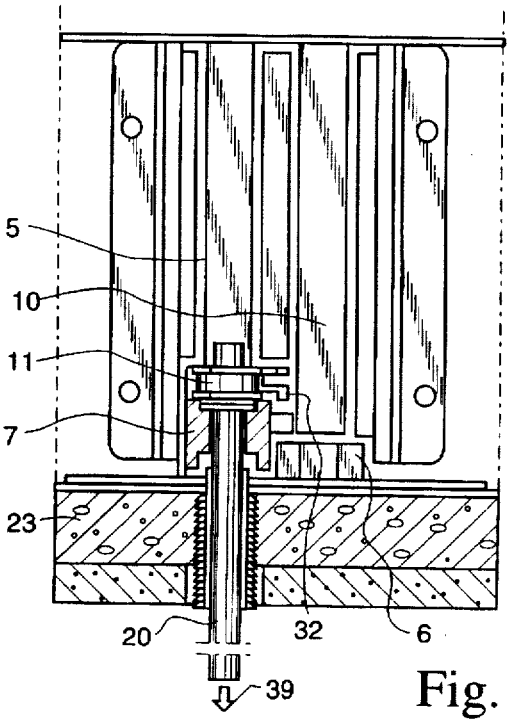
Fig. 6
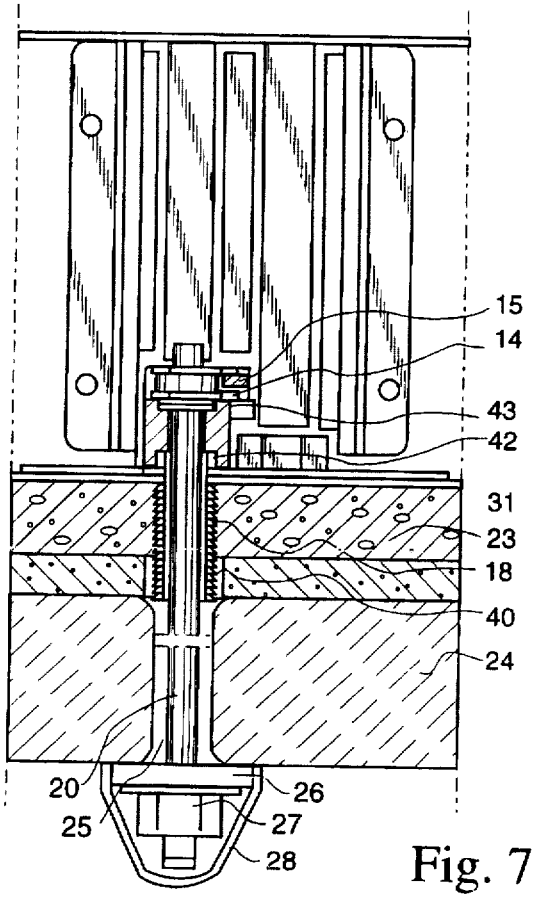
Fig. 7
Fig. 8
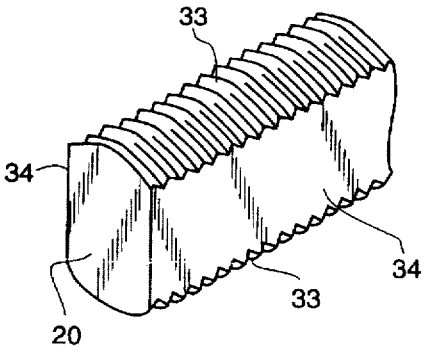

PLUMBING FIXTURE MOUNTING DEVICE USING A THREADED ROD WITH INTERRUPTED THREADS

FIELD OF THE INVENTION

The present invention pertains to a device for fastening a plumbing unit, e.g., a toilet bowl or a urinal, on a building wall or a stationary frame, and in particular to a device with at least one threaded rod, which is inserted with one of its ends into an opening of a holding device. The holding device is to be arranged in a rigid manner and the threaded rod is secured by the holding device.

BACKGROUND OF THE INVENTION

In a prior-art device of this class, the holding device is a mounting frame, which has been well known for a long time for the installation of plumbing units, e.g., urinals, in front of a wall. The mounting frame has two nut housings, which are arranged stationarily at spaced locations from one another. A nut is mounted in each of the nut housings and into each of the nuts a threaded bolt is screwed. During assembly, the threaded bolts must be screwed into the nuts to a defined depth of penetration corresponding to the facing. The positioned threaded bolts must finally be fixed by a lock nut. Time-consuming screwing in and out of the threaded bolts is often necessary in practice. After facing, the plumbing unit is placed on the projecting threaded rods and is fastened with additional nuts screwed onto the threaded rods. If the plumbing unit is damaged in the process, which not infrequently happens in the case of units made of ceramics, the lock nuts must first be exposed, and the threaded bolts repositioned, which is again associated with time-consuming screwing in and out. We also refer to the applicant's EP-A-0 407 351 concerning the state of the art.

SUMMARY AND OBJECTS OF THE INVENTION

The object of the present invention is to provide a device of the above-described type, in which the effort needed for mounting is reduced. This object is accomplished in the present invention by the threaded rod being able to be pushed into an opening of the holding device in the longitudinal direction during mounting to determine a correct position for fastening the threaded rod in the holding device. The holding device has means for the detachable fixation of the threaded rod in essentially each position of insertion that can be set. To set the depth of insertion in the opening, the threaded rod is not screwed in and out according to the present invention, but it is displaced in its longitudinal direction without rotation and is detachably fixed after it reaches the desired depth of insertion. If the depth of insertion is to be changed, the fixation is released, and the threaded rod is displaced into the new position. The previously time-consuming screwing in and out is thus avoided. The installation time can be substantially reduced with the device according to the present invention as compared with the prior-art devices.

According to a variant of the present invention, a carrier means for fixing the threaded rod can be changed over between at least two positions. The threaded rod is displaceable in its longitudinal direction in the first position of the carrier means, and the threaded rod is axially and radially rotationally secured in a second position of the carrier means. According to another variant of the present invention, the carrier means can be changed over between the two positions by rotating the threaded rod. These means are, e.g., displaced in the longitudinal direction of the threaded rod. The carrier means is secured by, e.g., stops against rotating in one position, in which the threaded rod is fixed. According to an advantageous variant of the present invention, the means are designed as a carrier ring, which secures the threaded rod against rotation in an adjustable position.

If a building protection sleeve is placed on the threaded rod according to a variant of the present invention, the depth of insertion of the threaded rod can be changed simply and rapidly even after the facing. Expensive pointing work can thus be avoided in the case of damage. To ensure the displaceability of the threaded rod in its longitudinal direction, e.g., the lock nut and the threaded rod may have interrupted teeth. To preset a minimum depth of insertion of the threaded rod, which is necessary at maximum facing, the building protection sleeve can be used during the preliminary installation in the building, which additionally simplifies the installation.

The holding device is, e.g., a mounting frame. However, it may also be a support or any other device that can be rigidly connected to a building wall. The device is used especially to fasten plumbing units, e.g., those made of ceramics, to a building wall.

Fastening of other units or devices, e.g., pipe clamps, to a building wall or a frame, is also conceivable.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 shows a view of a device according to the present invention,

FIG. 2 shows a section through the device along line II—II in FIG. 1,

FIG. 3 shows a section through the device along line III—III in FIG. 1,

FIG. 4 shows a section along line IV—IV in FIG. 1,

FIGS. 5 through 7 schematically show individual steps of the installation, and

FIG. 8 shows a perspective view of a section of a threaded bolt with interrupted threads.

DETAILED DESCRIPTION OF THE PREFERRED EMBODIMENT

The device 2 shown in FIG. 1 has a prior-art, so-called nut housing 3, which is rigidly arranged by fastening means 4 between two upright bends 35 of a wall 29 of a mounting frame 1. Two nuts 6 and 7 are mounted, rotating in unison, in the nut housing 3 in a mounting housing 5 behind a bracket 30. The nut 6 is of the usual design, while the nut 7 has interrupted teeth 8. The teeth are removed between the two teeth 8 on opposite areas 9 of the inside of the nut 7. The nut 7 thus has a non-round passage opening 36 (FIG. 2). Passages 10 and 16, which extend over the entire length of the nut housing 3, are located behind the nuts 6 and 7 in the mounting housing 5. The passages are used to support a threaded rod 20. Two such nut housings 3 are usually arranged on the mounting frame 1 at spaced locations next to each other.

The nut housing 3 is used to fasten the threaded rod 20 on the mounting frame 1. In the case of the usual fastening according to the state of the art, the threaded rod with continuous thread is screwed through an opening 37 of the mounting frame 1 into the nut 6. The threaded rod 20 is screwed into the nut 6 to the extent that it projects from the opening 37 over the required length. To prevent the threaded rod 20 from rotating and thus from changing its position, it is fixed with a nut, not shown here. The nut 6 is usually not used in the device according to the present invention.

If the nut 7 is used to fix the threaded rod 20, the rod 20 is pushed longitudinally without rotation through an opening 31 of the mounting frame 1 into the passage opening 36 of the nut 7. As was mentioned above, the teeth 8 of the nut 7 are interrupted. Corresponding to this, the teeth 33 of the threaded rod 20 are also interrupted on opposite parallel flanks 34 according to FIG. 8. The threaded rod 20 can thus be inserted in a specific rotated position into the opening 36, in which the threaded rod 20 is displaceable in the nut 7 in the longitudinal direction without meshing of threads. To set the necessary depth of insertion of the threaded rod 20, the threaded rod is thus displaced in the nut 7 without the meshing of threads. Once the desired depth of insertion has been reached, the threaded rod 20 is rotated clockwise until the thread 33 of the threaded rod 20 meshes with the thread 8 of the nut 7. To secure the threaded rod 20 against rotation, about its longitudinal axis, a carrier means 11, which has a passage opening 12 corresponding to the cross section of the threaded rod 20, is mounted in the mounting housing 5 behind the nut 7. The mounted threaded rod 20 engages this opening 12 and is also displaceable in it in the longitudinal direction. The carrier 11 is carried in the same direction during the rotation of the threaded rod 20. However, the rotatability of the carrier 11 is limited by two radially projecting dogs 13. As is shown in FIG. 3, the dogs 13 are on the top side of the wall 29 and limit a clockwise rotary movement if the opening 12 is arranged as shown in this figure. In this position, the threaded rod 20 correspondingly meshes with the threads of the nut 7. The threaded rod 20 is secured against clockwise rotation in this position of the carrier 11. To secure the threaded rod 20 in the counterclockwise direction as well, the carrier 11 is displaced by pulling the threaded rod 20 into the position shown in FIG. 7. The dogs 13 are now in contact with two connecting links 14 and 15 of the mounting housing 5 and prevent the carrier 11 from rotating counterclockwise as a result. This displacement of the carrier 11 and of the nut 7 rotatably connected thereto can be canceled by applying the corresponding counterpressure on the threaded rod 20, so that the two dogs 13 can again be rotated counterclockwise in recesses 32 (FIG. 6) of the mounting housing 5. In the position of the carrier 11 according to FIG. 7, the threaded rod 20 is secured axially by its threads meshing those of the nut 7, and rotationally by the meshing engagement with the carrier 11. A lock nut is consequently unnecessary. This fixation of the threaded rod 20 can be abolished by displacing the carrier 11 in the rearward direction and by a subsequent counterclockwise rotation of the threaded rod 20 by 90°. The threaded rod 20 can thus be brought at any time into a free position for resetting the depth of insertion. This can be done without tools and very rapidly.

FIG. 7 shows the device according to the present invention with a facing 23 and a plumbing unit 24, which is only partially indicated here. The threaded rod 20 passes through a passage opening 25 of the plumbing unit 24. The plumbing unit 24 is fastened to the device 2 with a washer 26 and a nut 27. A cap 28 may be placed on the projecting part of the threaded rod 20.

To make it possible to reset the threaded rod 20 even after the facing, a building protection sleeve 18, which leaves an opening 40 open in the facing 23 and makes possible the rotation of the threaded rod 20, is placed on the threaded rod 20. The sleeve 18 may be shortened and has circular grooves 22 for this purpose. The free end 21 of the sleeve 18 is closed and has a non-round inside 41, which is nonrotatably engaged by the threaded rod 20 during mounting. The threaded rod 20 can thus be rotated at the end 21 of the sleeve 18. A front end 42 of the building protection sleeve 18 has elastic snap-in tongues 19, which can be snapped into the opening 31.

A mounting process will be briefly explained based on FIGS. 5 through 7. FIG. 5 shows the threaded rod 20, which is inserted into the nut 7 and the carrier 11 and is covered with the building protection sleeve 18 at its projecting end. The building protection sleeve 18 is dimensioned such that it predetermines the minimum depth of insertion of the threaded rod 20 into the nut housing or the subsequent preliminary mounting in the building. Corresponding to the facing 23 provided and the length of the passage opening 25, the sleeve 18 is cut off at its free end. FIG. 6 shows the device 2 with the cut-off sleeve 18 and the facing 23. The carrier 11 is in the position here in which the threaded rod 20 is still displaceable in its longitudinal direction. To set the necessary depth of insertion, the threaded rod 20 is now displaced, and as soon as the desired depth of insertion has been reached, it is rotated until the dogs 13 come into contact with the wall 29. The threaded rod 20 is finally displaced in the direction of arrow 39 by tightening the nut 27, and the carrier 11, which is connected to the nut 7 via a flange 43 (FIG. 7), is thus moved into the position shown in FIG. 7. The nut 7, moving in the same direction, accommodates the end 42 of the sleeve 18, which end 42 projects on the inside at the bracket 30. The plumbing unit 24 is now put in place and secured with the washer 26 and the nut 27. As can be seen, the carrier 11 can no longer be brought into a position in which the threaded rod 20 would be rotatable without loosening the nut 27. However, such a resetting of the threaded rod 20 would be easily possible after loosening or removing the nut 27.

While specific embodiments of the invention have been shown and described in detail to illustrate the application of the principles of the invention, it will be understood that the invention may be embodied otherwise without departing from such principles.

What is claimed is:

1. A plumbing fixture mounting device comprising:

a holding device mountable on a support and defining an opening, said holding device including a nut coaxial with said opening of said holding device, said nut being rotationally fixed and axially displaceable in said holding device, a threaded rod longitudinally movable through said opening of said holding device without rotation of said threaded rod; and carrier means positioned in said holding device for detachably fixing said threaded rod to said holding device at a plurality of longitudinal positions of said threaded rod, said threaded rod being longitudinally slidable through said nut and said carrier means without rotation of said carrier means, said carrier means being rotatable with said threaded rod and rotably connected to said nut, said carrier means being movable between a first position where said threaded rod is displaceable in a longitudinal direction of said threaded rod and a second position where said threaded rod is axially and rotationally secured, said carrier means being movable from said first position to said second position by first a rotation of said carrier means and then an axial movement of said carrier means.

2. A device in accordance with claim 1, wherein:

said opening in said holding device and said threaded rod have interrupted teeth.

3. A device in accordance with claim 1, wherein:

said carrier means meshes with said threaded rod.

4. A device in accordance with claim 3, wherein:

said carrier means is limitedly rotatable by said threaded rod.

5. A device in accordance with claim 1, wherein:

said holding device includes a mounting housing holding said carrier means; and said carrier means is displaceably mounted in said mounting housing and is securable in a position in said mounting housing against rotation.

6. A device in accordance with claim 5, wherein: said nut is threadably engageable with said threaded rod; and said carrier means is rotably connected to said nut and rotably fixed in a starting position.

7. A device in accordance with claim 1, wherein:

said carrier defines an opening for accepting said threaded rod with a continuous thread.

8. A device in accordance with claim 1, further comprising:

a building protection sleeve placed on an end of said threaded rod.

9. A device in accordance with claim 8, wherein:

said building protection sleeve can be cut off and determines a depth of insertion of said threaded rod for preliminary installation.

10. A device in accordance with claim 8, wherein:

said building protection sleeve is fastened in said opening of said holding device.

11. A device in accordance with claim 1, wherein:

said carrier means includes dog means for locking said carrier means rotationally fixed when said carrier means is axially moved into said second position;

said threaded rod is longitudinally slidable in said nut in a first angular position of said threaded rod with respect to said nut, said threaded rod is longitudinally fixed to said nut when said threaded rod is positioned inside said nut and angularly moved away from said first angular position.

* * * * *